US005301622A

United States Patent [19]

Sakuma

[11] Patent Number: 5,301,622

[45] Date of Patent: Apr. 12, 1994

[54] LOOPER FOR SEWING MACHINE

[75] Inventor: Kouichi Sakuma, Yamagata, Japan

[73] Assignee: Suzuki Manufacturing, Ltd., Japan

[21] Appl. No.: 844,230

[22] Filed: Mar. 2, 1992

[51] Int. Cl.[5] ..... D05B 1/20; D05B 57/06

[52] U.S. Cl. ..... 112/162; 112/302

[58] Field of Search ..... 112/199, 200, 162, 302

[56] References Cited

U.S. PATENT DOCUMENTS

| | | | |
|---|---|---|---|
| 2,046,928 | 7/1936 | Riviere et al. | 112/199 |
| 2,599,226 | 6/1952 | Briem | 112/281 |
| 3,333,560 | 8/1967 | Wiener et al. | 112/199 |
| 4,799,439 | 1/1989 | Koshinaka et al. | 112/162 |

FOREIGN PATENT DOCUMENTS

| | | | |
|---|---|---|---|
| 483989 | 10/1929 | Fed. Rep. of Germany | 112/199 |
| 806514 | 7/1949 | Fed. Rep. of Germany | 112/199 |
| 6037 | of 1912 | United Kingdom | 112/200 |

*Primary Examiner*—Clifford D. Crowder
*Assistant Examiner*—Paul C. Lewis
*Attorney, Agent, or Firm*—Lorusso & Loud

[57] ABSTRACT

A looper mechanism for use in a sewing machine which includes a needle moved substantially vertically through a needle plate while inclined in a feed direction of cloth. The looper mechanism includes a lower looper which performs an arcuate reciprocating motion crosswise to the locus of the needle at the lower side of the needle plate, and an upper looper which performs an elliptically-arcuate reciprocating motion crosswise to the locus of the lower looper at the side of the needle plate and crosswise to the locus of the needle at the upper side of the needle. A needle thread which is passed through the needle, an lower-looper thread passed through the lower looper and an upper-looper thread passed through the upper looper being cross with one another to perform sewing. At least one of the upper looper and the lower looper has a hollow structure through which a looper thread is passed from a thread inlet of the looper to a tapered thread outlet. The hollow structure is a tube member and a groove engageable with the tube member, or the combination of a groove and a lid member covering the groove. The thread inlet of the looper may be funnel-shaped.

8 Claims, 6 Drawing Sheets

FIG. 3a
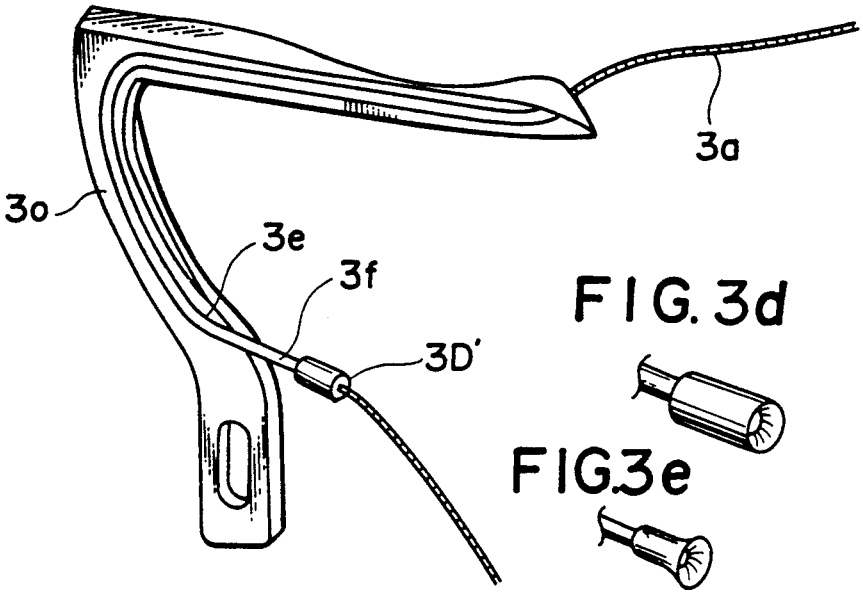
FIG. 3d
FIG3e
FIG. 3b
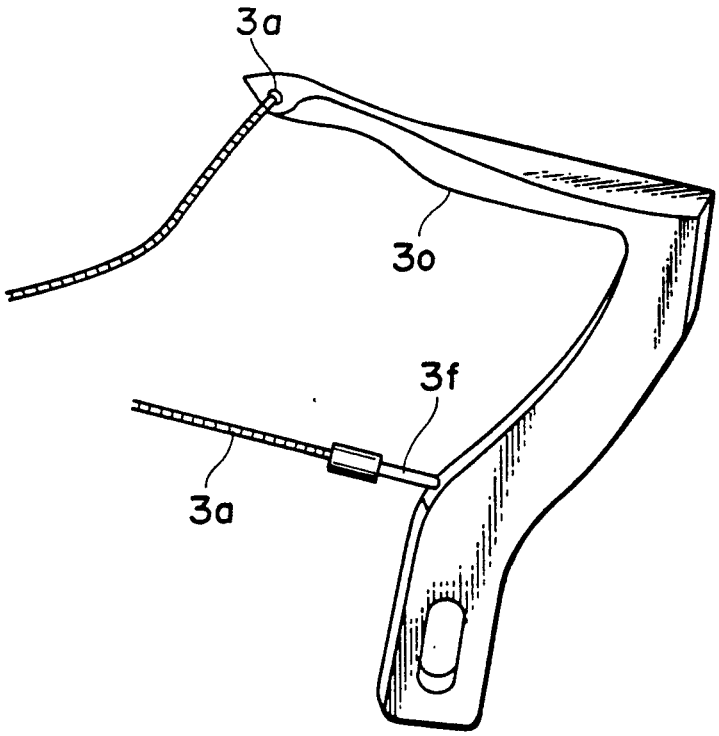

LOOPER FOR SEWING MACHINE

BACKGROUND OF THE INVENTION

1. Field of the Invention

This invention relates to a looper for a sewing machine, and particularly to a looper for an overlock machine and a double chair stitch sewing machine.

2. Description of Prior Art

FIG. 4 shows a conventional overlock machine. As shown in FIG. 4, the overlock machine includes a needle 1 which reciprocates substantially upwardly and downwardly through a needle plate 4 while inclined in the direction from which the cloth is fed, and is fixed to a needle bar which is moved substantially upwardly and downwardly in synchronism with a main shaft. A lower looper 3' performs an arcuate reciprocating motion transverse to the path of the needle 1 at the lower side of the needle plate 4, and an upper looper 2' performs an elliptically-arcuate reciprocating motion transverse to the locus of the lower looper 3' and transverse to the path of the needle 1. The depicted machine is a one-needle and three-thread type overlock machine in which a needle thread is passed through the needle 1, a lower-looper thread 3*a* is passed through the lower looper 3' and an upperlooper thread 2*a* is passed through the upper looper 2' and the three threads are crossed with one another in sewing.

In the overlock machine as described above, the needle 1 and the upper looper 2' are crossed above the needle plate 4 so that the thread 2*a* is hitched to the needle 1, the upper looper 2' and the lower looper 3' are crossed at the marginal portion of the cloth so that the thread 3*a* is hitched to the upper looper 2', and the needle 1 and the lower looper 3' are crossed below the needle plate 4 so that the needle thread (not shown) is hitched to the lower looper 3', thereby performing overlock sewing at the marginal portion of the cloth 5 and thus preventing a weaving thread from becoming frayed at the marginal portion of the cloth 5.

As shown in FIG. 5, a thread hole 2*b* serving as a thread outlet through which the thread 2*a* is to be drawn out is formed at a position adjacent to the tapered end 2A of the upper looper 2', and the thread 2*a* which has been guided by the an upper-looper thread guide 21 is passed through the thread hole 2*b*.

Likewise, as shown in FIG. 5, a thread hole 3*b* serving as a thread outlet through which the thread 3*a* is to be drawn out is formed at a position adjacent to the tapered end 3A of the lower looper 3', and, in order to prevent the thread 3*a* from disturbing the sewing operation, a thread groove 3*c* is cut in a thread supporting portion 3B and a thread guide 3*d* is provided in looper rear portion 3C. The thread 3*a* which has been guided by the lower-looper thread guide 32 is hitched to the lower-looper thread guide 31, and then passed through the thread hole 3*b* of the tapered end 3A of the lower looper 3'. The thread 3*a* located between the thread guide 3*d* of the looper rear portion 3C and the thread 3*b* retained and supported in the thread groove 3*c*.

Minute working using a tweezer has been conventionally required for passing the threads through the upper-looper thread hole 2*b* and the lower-looper thread hole 3*b*, hitching the thread to the thread guide 3*d* of the looper rear portion 3C, placing the lower-looper thread 3*a* into the thread groove 3*c*, etc. In addition, the manner of passing the thread through the looper portion is complicated as shown in FIG. 5, so that if the sewing operation is carried out in an incorrect threading order (for the overlock machine, the threading operation must be correctly carried out for (1) the lower-looper thread, (2) the upper-looper thread and (3) the needle thread in this order, for example), there would occur trouble such as the threads snapping at an initial stage of the sewing operation and the needle breaking.

In addition, since the thread groove 3*c* which is formed in the thread supporting portion 3B for the thread 3*a* is open at the front portion thereof, the thread 3*a* accommodated in the thread groove 3*c* is liable to be slackly suspended from the thread groove 3*c*, and this suspension of the thread might cause entanglement thereof with another thread or the like. Further, since the loopers 2' and 3' are installed in a narrow space below the needle plate 4, a finger or tweezer is hardly able to reach this area, and a skilled working technique is required particularly for passing the thread through the lower-looper thread guide 3*d* and the thread hole 3*b* of the lower looper 3' which is installed in the more inner portion. Therefore, it frequently occurs that an unskilled person can not correctly perform threading, a longer work time is required because the threading work itself requires a longer time, and a thread may be broken due to entanglement of the thread in the re-threading operation at the restarting of the sewing operation.

In order to overcome the above disadvantages, the following two approaches have been utilized. One approach utilizes a threading unit or a threading device (as disclosed in Japanese Patent Application Laid-open No. Hei-1-303194, for example). The other approach provides a clutch in a looper driving portion, and the looper is laid down by a switching operation of the clutch to thereby facilitate the threading operation. However, the threading unit and the threading device are expensive in price, are not stable in operation and require a special technique for use. In addition, it is difficult for an operator to understand the operation of the threading device, and thus a sewing machine is liable to be damaged due to an operator's misoperation.

SUMMARY OF THE INVENTION

An object of this invention is to provide a looper for a sewing machine, in which a thread is easily passed through a looper installed in a narrow space below a needle plate, and no trouble at starting or restarting of the sewing operation occurs even when an operator is an unskilled person, thereby shortening down time.

In order to attain the above object, an improved looper mechanism is provided for use in a sewing machine including a needle which is substantially upwardly and downwardly moved penetrably through a needle plate while inclined in the feed direction of the cloth. In such a sewing machine the needle is fixed to a needle bar which is substantially upwardly and downwardly moved in synchronism with a main shaft. The looper mechanism includes a lower looper which performs an arcuate reciprocating motion crosswise of the locus of the needle at the lower side of the needle plate, and an upper looper which performs an elliptically-arcuate reciprocating motion crosswise to the locus of the lower looper at the lower side of the needle plate and crosswise to the locus of the needle at the upper side of the needle. A needle thread is passed through the needle, a lower-looper thread passed through the lower looper and an upper-looper thread passed through the upper looper, the three threads being crossed with one another to perform sewing. In the improved looper mechanism at least one of the upper looper and the lower looper have a hollow structure through which a looper thread is passed from a thread inlet of the looper to a tapered thread outlet.

That is, the hollow structure is formed of a hollow member, or by combination of a tube member through which the looper thread is passed from the thread inlet of the looper to the tapered thread outlet, and an arm member with a groove with which the tube member is engaged. The hollow structure may also be formed of the combination of a groove through which the looper thread is passed from the thread inlet of the looper to the tapered thread outlet, and a lid member covering the groove.

The thread inlet of the looper is in the form of a funnel.

PREFERRED EMBODIMENTS OF THIS INVENTION

Preferred embodiments of this invention will be described hereinafter with reference to the accompanying drawings.

Figure 1:
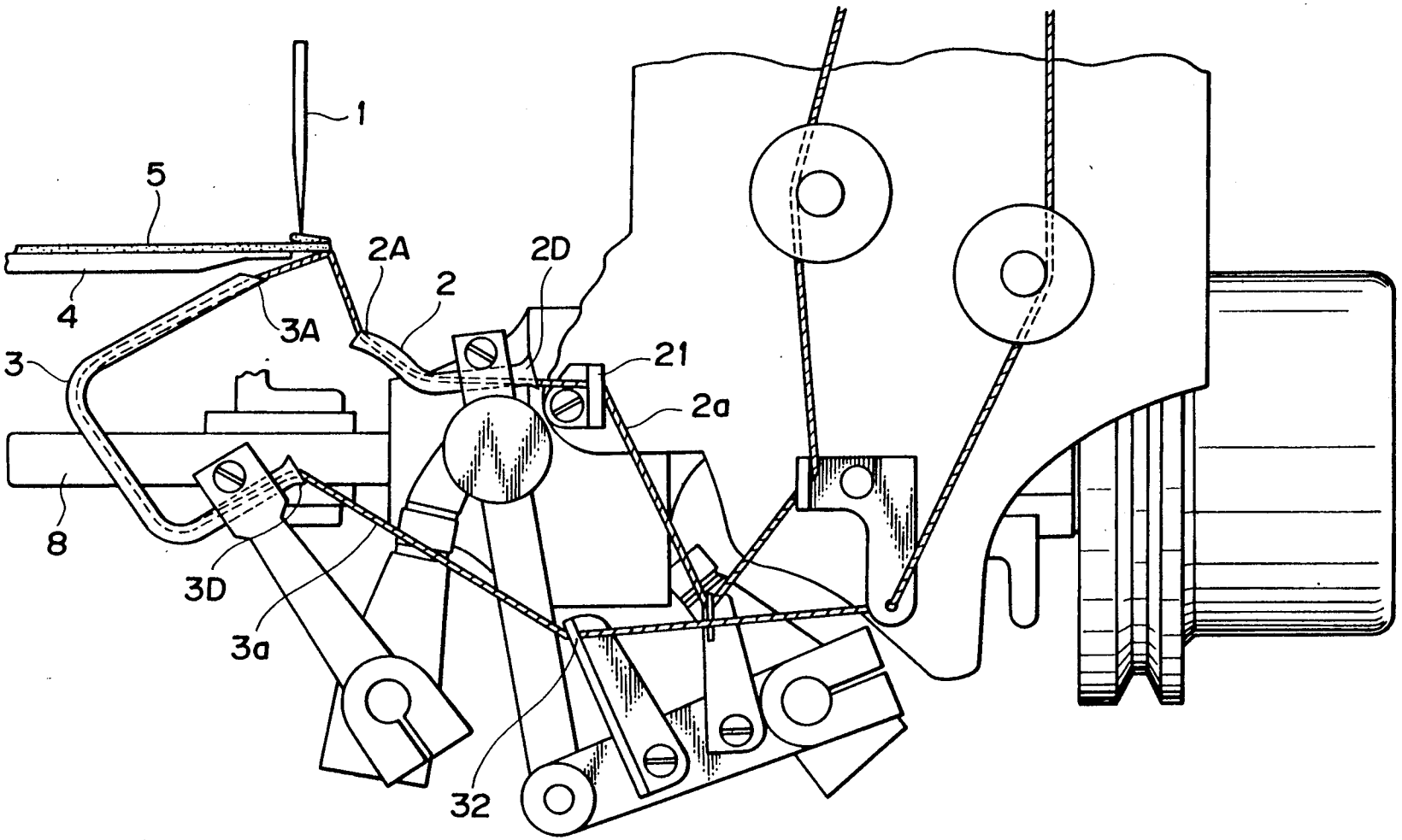
FIG. 1 is an elevational view of an overlock machine having a looper mechanism according to this invention.

FIG. 1 shows a looper portion of an overlock machine to which a looper according to this invention is adapted.

As shown in FIG. 1, a lower looper 3 of a sewing machine according to this invention has a hollow structure suitable for passing a lower looper thread 3*a* therethrough, and has a thread inlet 3D and a tapered thread outlet 3A. Likewise, an upper looper 2 of the sewing machine also has a hollow structure suitable for passing an upper looper thread 2*a* therethrough, and has a thread inlet 2D and a tapered thread outlet 2A.

FIRST EMBODIMENT

Figure 2A:
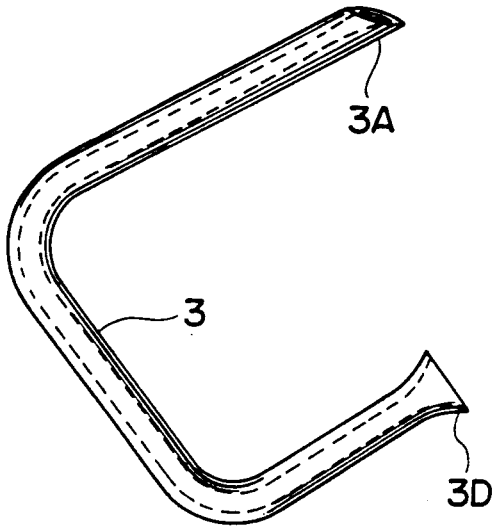
FIG. 2(*a*) is a plan view of a lower looper, FIG. 2(*b*) is a plan view an upper looper, and FIG. 2(*c*) is a plan view of a threading device.
Figure 2B:
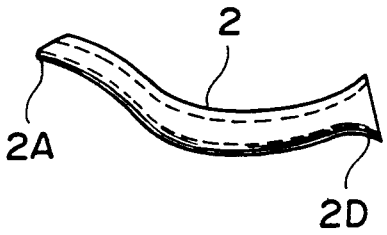
Figure 2C:
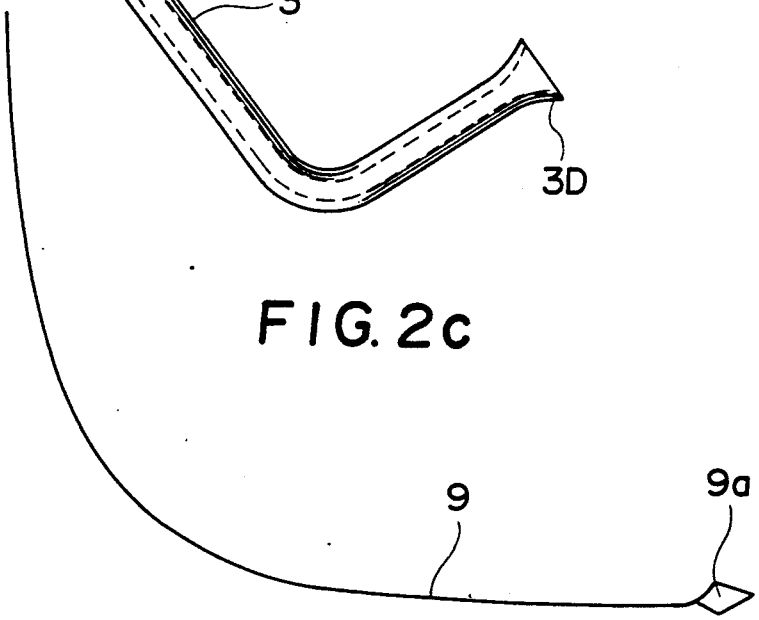

FIGS. 2(*a*) and 2(*b*) show an embodiment of the hollow structure of the upper and lower loopers 2 and 3. The hollow structure of the upper looper 2 is formed of a tubular hollow member through which a looper thread (not shown) passes from the thread inlet 2D to the tapered thread outlet 2A, as shown in FIG. 2(*b*). Likewise, the hollow structure of the lower looper 3 is formed of a tubular hollow member through which the looper thread (not shown) passes from the thread inlet 3D to the tapered thread outlet 3A, as shown in FIG. 2(*a*).

SECOND EMBODIMENT

Figure 3C:
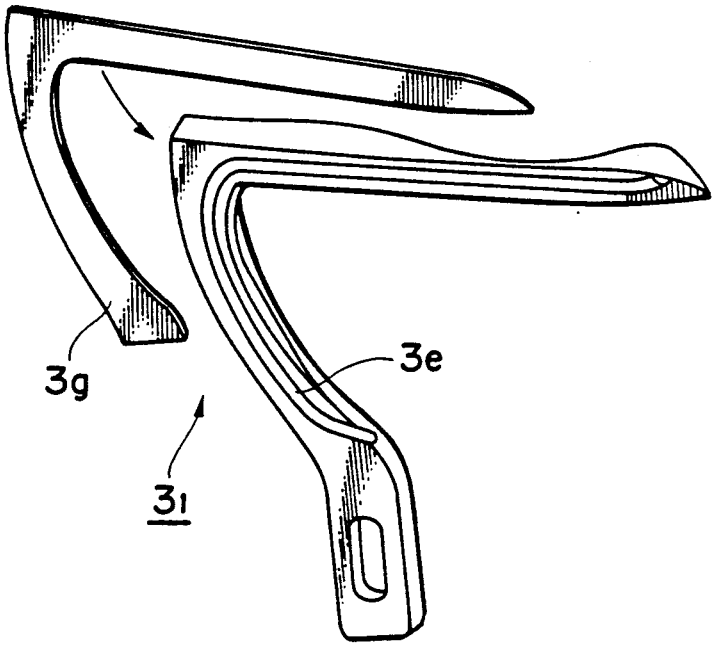
FIGS. 3(*a*), 3(*b*) and 3(*c*) show another embodiment of a lower looper having a hollow structure, and FIGS. 3(*d*) and 3(*e*) show the funnel-shaped structure of a thread inlet of the looper.

FIGS. 3(*a*) and 3(*b*) show another embodiment of the hollow structure of the lower looper $3_0$. As shown in FIGS. 3(*a*) and 3(*b*), the hollow structure of the lower looper $3_0$ is formed of a pipe 3*f* comprising a tubular member through which a lower looper thread 3*a* is passed from the thread inlet 3D' to the thread outlet 3A', and a groove 3*e* receives the pipe 3*f* (as shown in FIG. 3(*c*)).

THIRD EMBODIMENT

FIG. 3(*c*) shows another embodiment of the hollow structure of the lower looper $3_1$. As shown in FIG. 3(*c*), the hollow structure of the lower looper $3_1$ is formed of a groove 3*e* through which the looper thread is passed from the thread inlet thereof to the tapered thread outlet thereof, and a lid member 3*g* adapted to cover the groove 3*e*.

In each type of hollow structures of the first to third embodiments as described above, the thread inlet of each of the upper and lower loopers 2 and 3 is funnel-shaped, that is, is trumpet-shaped, which is suitable for passing the looper thread therethrough (as shown in FIGS. 2(*a*), 2(*b*), FIGS. 3(*d*) and 3(*e*)).

Figure 4:
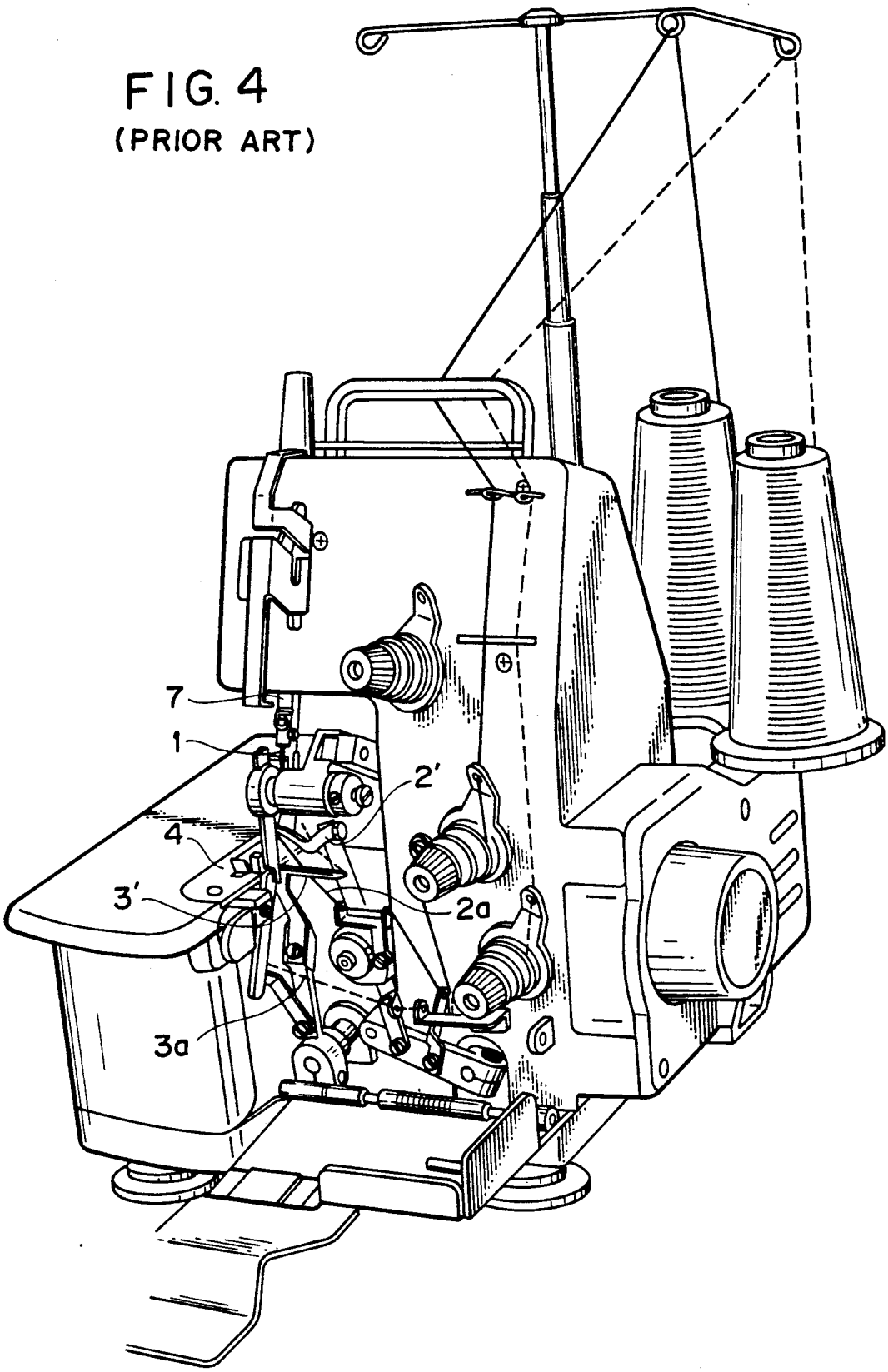
FIG. 4 (PRIOR ART)
FIG. 4 is a perspective view of the overlock machine.
Figure 5:
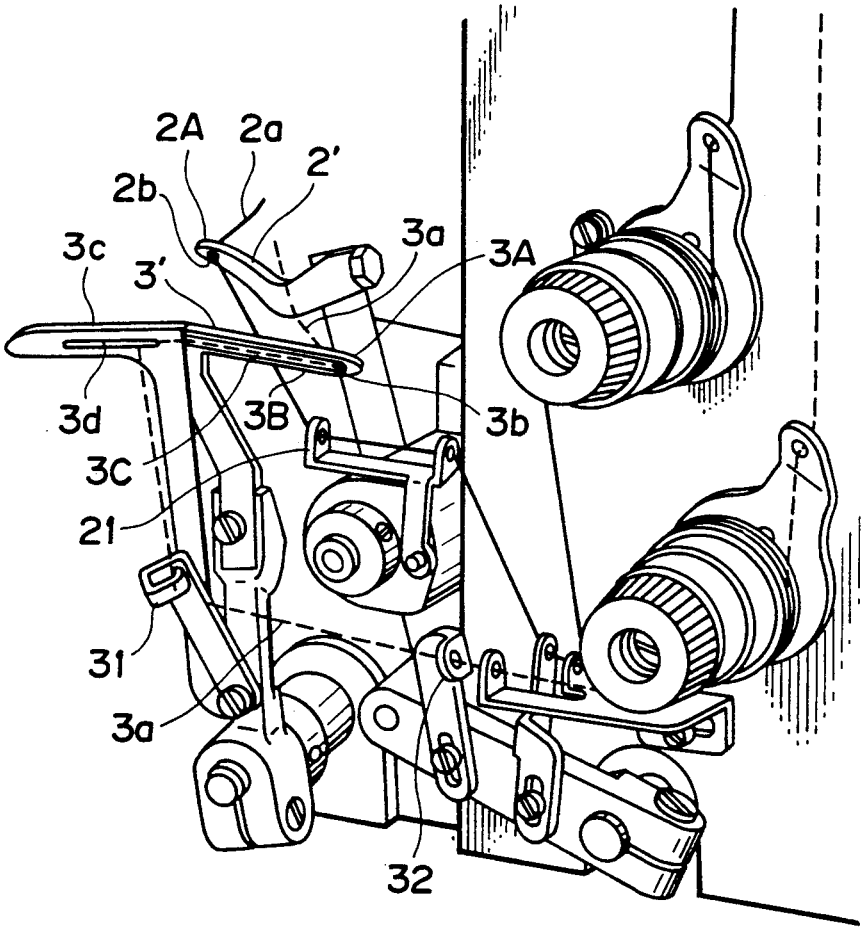
FIG. 5 is an enlarged view of the looper portion of the overlock machine as shown in FIG. 4.

As shown in FIG. 1, the body of the overlock machine includes a needle 1 which is substantially upwardly and downwardly moved penetrably through a needle plate 4 while inclined in the direction from which the cloth is fed, and is fixed to a needle bar 7 (as shown in FIG. 4) which is substantially upwardly and downwardly moved in synchronism with a main shaft. A lower looper 3 which performs an arcuate reciprocating motion transverse to the path of the needle 1 at the lower side of the needle plate 4, and an upper looper 2 which performs an elliptically-arcuate reciprocating motion transverse to the path of the lower looper 3 and transverse to the path of the needle 1. A needle thread is passed through the needle 1, a lower-looper thread 3*a* is passed through the lower looper 3 and an upper-looper thread 2*a* is passed through the upper looper 2, the three threads crossing one another to perform an overlock sewing in the cloth.

Operation of the looper according to this invention thus constructed will be described hereinafter.

In a case where the looper is formed of a tubular hollow member, as shown in FIG. 1, the lower looper thread 3*a* is passed through lower looper thread guide 32 and is then inserted into a support hole 9*a* of a threading unit 9 (as shown in FIG. 2(*c*)). The threading unit 9 is inserted through the thread inlet 3D of the lower looper 3 while retaining the lower-looper thread 3*a* in the support hole 9*a* thereof and, when the threading unit 9 projects out from the tapered thread outlet 3A of the lower looper 3, it is pulled out of the tapered thread outlet 3A, whereby the threading operation is completed.

In a case where the looper comprises the groove 3*e* and the pipe 3*f*, the lower looper thread 3*a* which has been guided by the lower-looper thread guide 32 is passed through the threading unit 9, the threading unit 9 is inserted through the thread inlet 3D' of the pipe 3*f*, and then the threading unit 9 which extends from the thread outlet 3A' of the pipe 3*f* is drawn out from the thread outlet 3A.

In a case where the looper comprises the groove 3*e* and the lid member 3*g*, the lid member 3*g* is secured to the groove 3*e*, the lower-looper thread 3*a* which has been guided by the lower-looper thread guide 32 is passed through the threading unit 9, the threading unit 9 is inserted through the thread inlet of the groove 3*e*, and then the threading unit 9 which extends from the thread outlet of the groove 3*e* is drawn out from the thread outlet.

The above operation pertains to the lower looper 3, however, the same operation is applicable to the upper looper.

The looper of this invention is effectively applicable not only to an overlock machine, but also to a double chain stitch sewing machine.

As is apparent from the embodiments as described above, at least one of the upper and lower loopers according to this invention has a hollow structure through which the looper thread is passed from the thread inlet of the looper to the tapered thread outlet of the looper, so that an erroneous threading can be prevented. In addition, the thread is prevented from being slackly suspended in a mid-section of its path, so that the threaded looper thread is prevented from becoming entangled with another thread, and even a beginner can correctly and simply perform a threading operation. Further, the threading operation using the looper of this invention is easily performed by an operator and no special technique is required for the threading operation, so that damage to the sewing machine due to misoperation is prevented.

In addition, the threading order itself is unimportant, the threading operation can be carried out at any situation in each operation of the sewing machine, and the rethreading operation owing to the snapping of the thread during the sewing operation may be carried out using no special technique, without taking off other threads, while preventing the thread from snapping again because the entanglement of the threads is prevented. Further, according to this invention, no special threading device is required, a sewing machine having low price can be provided and an economical threading unit may be used.

What is claimed is:

1. A looper mechanism for use in a sewing machine wherein a needle is fixed to a needle bar which is reciprocated substantially upwardly and downwardly for penetration through a needle plate while inclined in the direction of cloth feed, in synchronism with a main shaft, said looper mechanism comprising:

a lower looper which performs an arcuate reciprocating motion crosswise to the locus of the needle at the lower side of the needle plate, and an upper looper which performs an elliptically-arcuate reciprocating motion crosswise to the locus of the lower looper at the lower side of the needle plate and crosswise to the locus of the needle at the upper side of the needle plate, whereby a needle thread passed through the needle, a lower-looper thread passed through the lower looper and an upper-looper thread passed through the upper looper cross with one another sewing the cloth, said looper mechanism having at least one of said upper looper and said lower looper including a tube member in the form of a hollow circular cylinder through which a looper thread is passed from a thread inlet end of said one looper to a thread outlet end of said one looper, said tube having opposing open ends defining said thread inlet end and said thread outlet end, respectively.

2. The looper mechanism as claimed in claim 1, wherein said one looper further includes an arm member and a groove in said arm member in which said tube member is mounted, said tube member being coextensive with said groove.

3. The looper mechanism as claimed in claim 1, wherein said thread outlet end is tapered.

4. The looper mechanism as claimed in claim 1, wherein said thread inlet end of said tube member is funnel-shaped.

5. The looper mechanism as claimed in claim 2, wherein said arm member consists of two portions joining each other at approximately a right-angle.

6. The looper mechanism as claimed in claim 1, wherein said tube member has at least one bend at approximately a right-angle.

7. A looper mechanism for use in a sewing machine wherein a needle is fixed to a needle bar which is reciprocated substantially upwardly and downwardly for penetration through a needle plate while inclined in the direction of cloth feed, in synchronism with a main shaft, said looper mechanism comprising:

a lower looper which performs an arcuate reciprocating motion crosswise to the locus of the needle at the lower side of the needle plate, and an upper looper which performs an elliptically-arcuate reciprocating motion crosswise to the locus of the lower looper at the lower side of the needle plate and crosswise to the locus of the needle at the upper side of the needle plate, whereby a needle thread passed through the needle, lower-looper thread passed through the lower looper and an upper-looper thread passed through the upper looper cross with one another sewing the cloth, said looper mechanism having at least one of said upper looper and said lower looper including an arm member, a groove in said arm member and a lid covering said groove to define a closed hollow through which one of the threads is passed.

8. The looper mechanism as claimed in claim 7, wherein said arm member and said lid have a bend of approximately 90°.

* * * * *